US010706685B2

(12) United States Patent
Nelson et al.

(10) Patent No.: US 10,706,685 B2
(45) Date of Patent: Jul. 7, 2020

(54) SKILL BASED WHEEL MODIFIERS

(71) Applicant: IGT, Las Vegas, NV (US)

(72) Inventors: Dwayne Nelson, Las Vegas, NV (US); Cameron Filipour, Las Vegas, NV (US)

(73) Assignee: IGT, Las Vegas, NV (US)

( * ) Notice: Subject to any disclaimer, the term of this patent is extended or adjusted under 35 U.S.C. 154(b) by 49 days.

(21) Appl. No.: 15/996,873

(22) Filed: Jun. 4, 2018

(65) Prior Publication Data

US 2019/0371125 A1 Dec. 5, 2019

(51) Int. Cl.
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/34* (2013.01)

(58) Field of Classification Search
CPC ..... G07F 17/3262
See application file for complete search history.

(56) References Cited

U.S. PATENT DOCUMENTS

| | | | | |
|---|---|---|---|---|
| 6,780,103 | B2 * | 8/2004 | Bansemer | A63F 9/0291 463/25 |
| 9,147,310 | B2 * | 9/2015 | Jones | G07F 17/32 |
| 2003/0114208 | A1 * | 6/2003 | Lorant | A63F 13/08 463/7 |
| 2008/0234021 | A1 * | 9/2008 | Palmer | G07F 17/32 463/2 |
| 2014/0087844 | A1 * | 3/2014 | Gilliland | A63F 13/00 463/25 |
| 2015/0087403 | A1 * | 3/2015 | Castro | G07F 17/3209 463/25 |
| 2017/0228976 | A1 * | 8/2017 | Chesworth | G07F 17/3227 |
| 2019/0026974 | A1 * | 1/2019 | Casey | G07F 17/3213 |
| 2019/0035221 | A1 * | 1/2019 | Colvin | G07F 17/3209 |
| 2019/0080551 | A1 * | 3/2019 | Marston | G07F 17/3213 |
| 2019/0130705 | A1 * | 5/2019 | Nelson | G07F 17/3262 |

* cited by examiner

*Primary Examiner* — Jay Trent Liddle
(74) *Attorney, Agent, or Firm* — Sheridan Ross P.C.

(57) ABSTRACT

Disclosed are various embodiments for generating an outcome for a wheel-based gaming feature based on one or more digital tokens. A skill-based input can be received. The one or more digital tokens can be launched toward a wheel of the wheel-based gaming feature based on the skill-based input. A landing location for the one or more digital tokens can be determined. One or more aspects of the wheel-based gaming feature can be modified based on the landing locations of the digital tokens.

20 Claims, 11 Drawing Sheets

SKILL BASED WHEEL MODIFIERS

BACKGROUND

A slot machine is a casino gambling machine with reels of indicia. When a wager is placed, a wagering game can be initiated on the slot machine. The wagering game can involve the reels of indicia spinning into random positions. An award for the wagering game can be determined using the random positions of indicia. The positions of the indicia can be compared to outcomes in a pay table. For some outcomes, a bonus game can be initiated. The bonus game can award an additional award to a patron.

The bonus game can include a wheel. The wheel can spin around during the bonus game. The wheel can be divided into a number of equal segments and the odds of winning each segment can differ from one another or be equal depending on the game being played. Each segment can be associated with a number. The wheel can include a pointer that rubs against the wheel to slow it down. When the wheel stops, the number associated with the segment pointed can be awarded to the patron.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

In a casino, patrons can wager money on gaming device, such as a slot machine. The gaming device can utilize probability to randomly select one of several potential outcomes. Some of the potential outcomes include activating game features or bonus games. Although the outcome of a gaming device is typically out of the hands of a patron, a game feature or bonus game can involve an element of skill or provide a patron with a perception that the game involves skill, which is referred to herein as pseudo skill.

The gaming devices can include a mechanical element, such as a wheel, or one or more displays that render a digital representation of the mechanical element. The gaming devices can include several inputs that may be used to facilitate a skill-based game, such as touching a display to launch a digital token toward the wheel. The patron can launch the digital token toward the target by swiping on a display of the gaming device toward the wheel. The properties of the travel path, also referred to as a trajectory, for the digital token can be based on the swiping on the display or on some other skill-based input.

The gaming device can award one or more digital tokens based on comparing outcomes of the wagering game to a pay table. A patron can collect digital tokens while playing the wagering game. When a wheel-based gaming feature is awarded, the patron can launch the collected digital tokens toward a wheel to alter one or more aspects of the wheel-based gaming feature.

The patron can use the gaming device to aim the digital token at a desired target. Where the digital token lands on the wheel is based primarily on how much skill the patron exhibits while launching the digital token. The patron can utilize skill modify one or more aspects of the wheel-based gaming feature to influence and/or control the outcome, rather than relying on random probability for the outcome of the wheel. In the following discussion, a general description of the system and its components are provided, followed by a discussion of the operation of the same.

Figure 1:
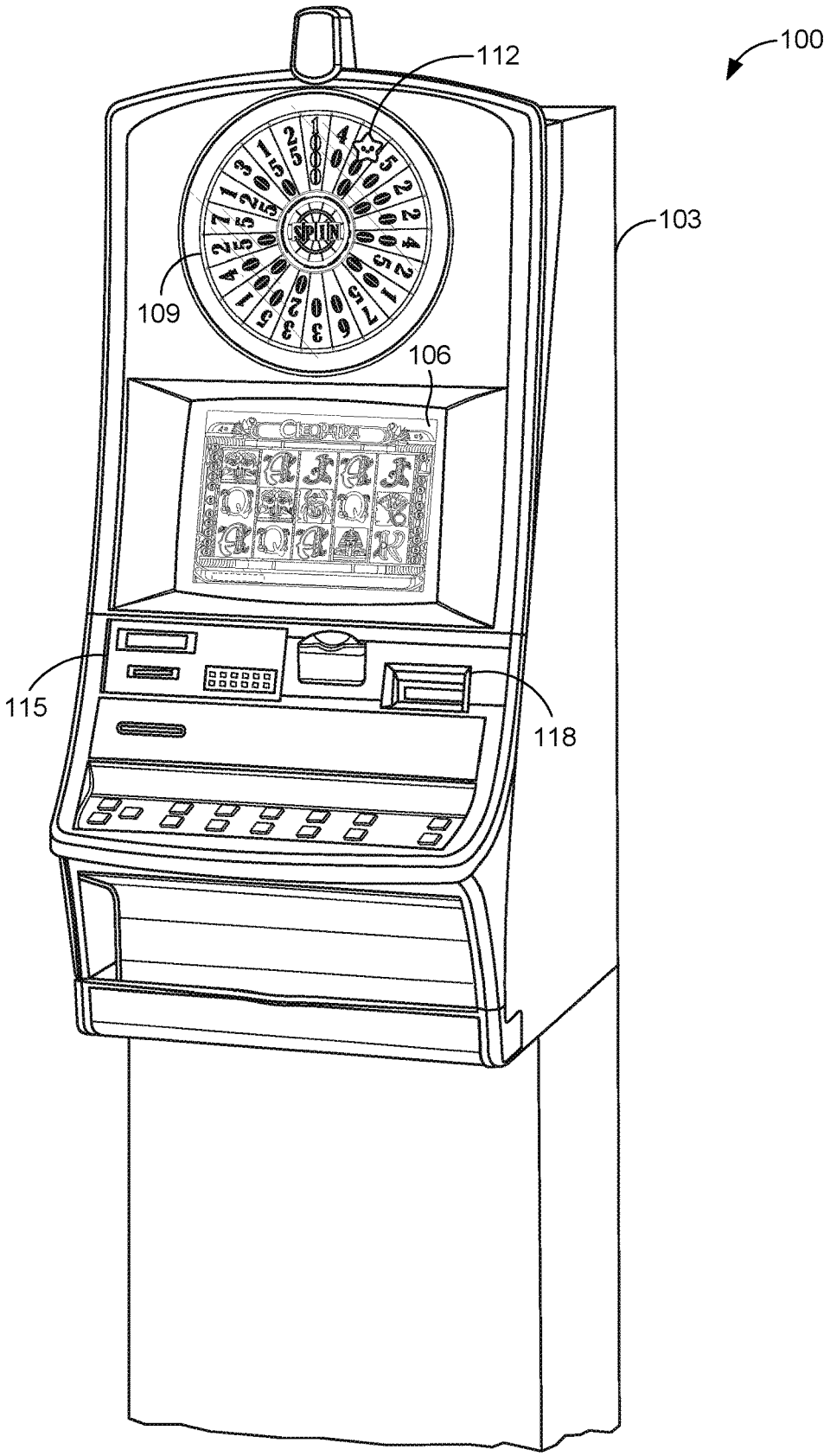
FIG. 1 is an illustration of a gaming environment according to various embodiments of the present disclosure.

With reference to FIG. 1, shown is a gaming environment 100 according to various embodiments. The gaming environment 100 includes a gaming device 103. The gaming device 103 can have one or more displays to facilitate the playing of wagering game, such as, for example, display 106. The wagering game can include a skill-based feature such that the skill of a patron can impact or appear to impact the outcome of the wagering game. The skill-based feature can include a skill-based input. The skill-based input can also include a pseudo skill-based input. The gaming device 103 can include a wheel 109 to add additional functionality to the wagering game, including the skill-based feature, such as a wheel-based gaming feature. The wheel-based gaming feature can be a bonus game. During the wagering game, a patron can launch a digital token 112 toward the wheel 109. The gaming device 103 can include a player tracking module 115.

The wheel 109 can be a physical wheel or a digital wheel rendered on a display. The wheel 109 can include one or more indicia positioned around the wheel 109. In some embodiments, a physical wheel 109 can include a cover over the wheel 109 to avoid direct contact with the wheel 109 during play. The cover can be made from a piece of glass, a piece of plastic, or some other material. The cover can be transparent or semi-transparent. In some embodiments, a display can be overlaid onto the cover. The display can be transparent where nothing is rendered on the display and opaque or semi-transparent where something is rendered. In some embodiments, the digital token 112 can be shown on a physical wheel 109 by rendering the digital token 112 on the display overlaid onto the cover.

The physical wheel 109 can include one or more indicator corresponding to each indicia to facilitate showing where the digital token 112 is located on the wheel 109. As an example, the gaming device 103 can determine the digital token 112 lands on an indicia, and illuminate a portion of a ring around the wheel 109 that corresponds to the indicia. As another example, a light under a selected indicia can be illuminated to indicate the digital token 112 landed on the indicia. The indicator corresponding to each indicia can show which type of digital token 112 lands on the indicia or be a single indicator for all types of digital tokens 112, such as a light.

The patron can utilize one or more inputs of the gaming device 103 to participate in the skill based feature of the wagering game. As an example, the patron can swipe across a touch screen display of the display 106 to simulate the launching of a digital token 112 toward the wheel 109. The gaming device 103 can determine a resulting location on the wheel 109 for the digital token 112 to land based on the skill-based input, among other factors. As an example, the resulting location on the wheel 109 can be determined based on characteristics of a motion of a finger when swiping across the screen such as speed and direction. As another example, the resulting location on the wheel 109 can be determined based on selecting a direction and strength to launch. A patron can select a direction and strength to launch using a slingshot, a virtual gun, a rocket, or some other contraption or mechanism. The patron can select a direction and strength by a throwing a character, a kicking a character, or some other mechanism. In some embodiments, the digital token 112 can miss the wheel 109 when a trajectory of the digital token based on the direction and strength of the launch results in a location off of the wheel 109.

The digital token 112 can modify an aspect of the wheel 109 during a wheel-based gaming feature of the wagering game. The aspect of the wheel-based gaming feature can be based on a type of digital token 112. As an example, a digital token 112 of a first type can alter the wheel-based gaming feature in a different way than a digital token 112 of a second type. Modifying the aspect of the wheel 109 can include altering a size of an indicia, changing a position of an indicia, changing a spin rate of the wheel 109, altering a stopping force of the wheel 109, altering a probability of the wheel 109 stopping at an indicia, slowing down the wheel 109 while over an indicia, speeding up the wheel 109 while over an indicia, selecting a different indicia when the wheel 109 lands on an indicia, altering an award of winning an indicia, or some other aspect.

In some embodiments, the player tracking module 115 can utilize a portion of the display 106 or a display corresponding to the wheel 109. As an example, the gaming device 103 can render a window on a portion of the display 106 including patron information. The player tracking module 115 can communicate with one or more gaming systems and can enable a gaming device 103 to track game play activity of the patron. The gaming device 103 can also include a cash in device 118, such as a bill validator or a coin acceptor. These cash in devices 118 can be used by the patron to deposit a physical currency in the gaming device 103. For example, the bill validator can receive monetary notes. The bill validator can verify that the bill deposited is a real bill rather than a fake bill. The bill validator can send the monetary value and validity of each bill deposited to game application executed in the gaming device 103. The game application can increment a cash balance in a wagering game using the monetary value.

The bill validator can also scan a barcode of a ticket deposited in the bill validator. Data corresponding to the barcode can be transmitted to the game application. The game application can verify the barcode with the gaming system to determine whether there is a credit balance associated with the deposited ticket. The gaming device 103 can also include a cash out device such as a ticket printer. When the patron wishes to terminate a gaming session, the patron can provide an input using an input device to initiate a cash out.

The game application can cause the ticket printer to print a cash out ticket with a barcode. This barcode corresponds to data stored in one or more gaming system. The gaming system can associate the monetary value of the credit balance at the gaming device 103 with the barcode data. As will be appreciated by those skilled in the art, mechanisms other than those described herein may be used to cash in or cash out with gaming device 103 without departing from the scope of the disclosure.

Figure 2A:
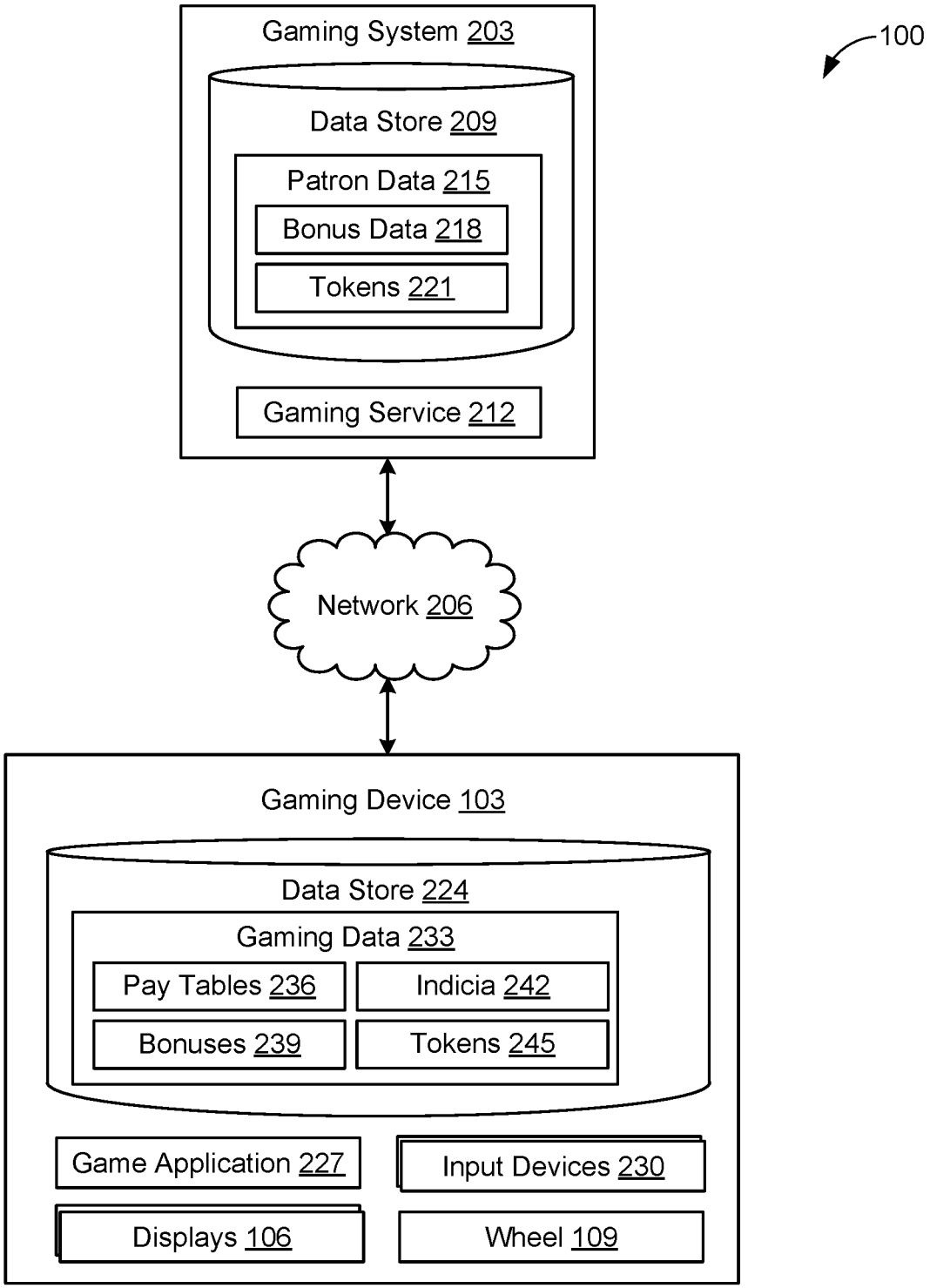
FIG. 2A is a diagram of an example gaming environment according to various embodiments of the present disclosure.

With reference to FIG. 2A, shown is an example embodiment of an example of the gaming environment 100 according to various embodiments. The gaming environment 100 includes a gaming system 203 and a gaming device 103, which are in data communication with each other via a network 206. The network 206 can include, for example, the Internet, intranets, extranets, wide area networks (WANs), local area networks (LANs), wired networks, wireless networks, other suitable networks, etc., or any combination of two or more such networks.

The gaming system 203 can include a data store 209 and a gaming service 212. The data store 209 can include patron data 215 including bonus data 218, digital tokens 221, and potentially other data. The bonus data 218 can include bonuses won by a patron. In some embodiments, the bonus data 218 includes a queue of pending bonuses that the patron has not yet played. The digital tokens 221 can include digital tokens accumulated by a patron. A patron can win one or more digital tokens as an outcome of a wagering game. The patron can accumulate the digital tokens for use during a wheel-based gaming feature. The digital tokens can be stored in digital tokens 221 until the patron wins a wheel-based gaming feature. In some embodiments, the patron must use all accumulated digital tokens in digital tokens 221 during each wheel-based gaming feature. In other embodiments, the patron can select whether to use one or more digital tokens 221 during each wheel-based gaming feature.

The gaming device 103 can include a data store 224, a game application 227, one or more displays 106, one or more input devices 230, a wheel 109, and other components. In other embodiments, the gaming device 103 corresponds to a personal computer of a patron in communication with the gaming service 212 and configured to allow the personal computer to securely execute a game application 227. As an example, while on a personal computer, a patron can play on an online slot machine or card game served up from a gaming service 212. The personal computer can include special purpose hardware to verify the location of the personal computer is within a gaming jurisdiction. The special purpose hardware can also enable and verify the secure execution of one or more gaming applications 227 with the server. The verification of the gaming application 227 by the gaming service 212 can ensure that game application 227 is not modified by the patron and to prevent cheating. In some embodiments, the wheel 109 can be rendered on the display 106. As an example, if a personal computer has only one display 106, the display 106 can be used for the wagering game and the wheel-based gaming feature.

The gaming device 103 can include, for example, a slot machine. The gaming device 103 can be communicably coupled to a gaming system 203 that includes one or more backend servers facilitating functionality of a slot machine. As such, the gaming system 203 can employ a plurality of computing devices that may be arranged, for example, in one or more server banks or computer banks or other arrangements. Such computing devices may be located in a single installation or may be distributed among many different geographical locations. As an example, the gaming device 103 can include one or more computing devices located on a floor of a casino in a slot machine, while one or more computing devices of a gaming system 203 may be part of a cloud or a server bank.

Various applications and/or other functionality may be executed in the gaming device 103 according to various embodiments. Also, various data is stored in a data store 224 that is accessible to the gaming device 103. The data stores 209 and 224 can be representative of a plurality of data stores 209 and 224 as can be appreciated. In some embodiments, one or more data stores 224 can be hosted separate from the gaming device 103 by the gaming system 203. The data stored in the data stores 209 and 224, for example, are associated with the operation of the various applications and/or functional entities described below.

The components executed on the gaming device 103, for example, include the game application 227, and other applications, services, processes, systems, engines, or functionality not discussed in detail herein. The game application 227 is executed to provide a wagering game, such as for example, a slot game, a card game, a bingo game, or other wagering game. The game application 227 can render the wagering game on one or more displays 106. The game application 227 can also receive inputs from one or more input devices 230. The input devices 230 can include one or more buttons, one or more touch screen input devices, one or more motion sensors, a mouse, a keyboard, a card reader device, cameras, eye tracking devices, or another input.

The data stored in the data store 224 includes, for example, gaming data 233 and potentially other data. The gaming data 233 can include pay tables 236, bonuses 239, indicia 242, digital tokens 245, and potentially other gaming data. The pay tables 236 can include a list of payouts for the gaming device 103. The pay tables 236 can include payouts for different combinations of symbols. The bonuses 239 can include various bonus games available for the game application 227, such as, for example, wheel-based bonus games. The indicia 242 can include various symbols for the game application 227 including indicia for the wheel-based gaming features. The digital tokens 245 can information describing different digital tokens available in the wheel-based gaming feature. For example, the digital tokens 245 can store a list of digital token types. The digital tokens 245 can include characteristics for each of the digital token types. The characteristics can include aspects of the wheel-based gaming features that each digital token can modify as well as how the digital token can modify the features.

Next, a general description of the operation of the game application 227 is provided. To begin, the game application 227 can generate a user interface corresponding to a game on the display 106. The user interface can include one or more indicia, such as indicia 242. As an example, the indicia 242 can be organized into columns and rows, and the game application 227 can provide outcomes of a wagering game in response to a patron placing a bet. One or more digital tokens can be awarded based on the outcome of the wagering game. According to one example, a digital token is awarded when three of a predefined indicia 242 are visible in a base game. In some embodiments, different predefined indicia 242 can result in an award of different types of digital tokens 245. The outcomes can include a base game outcome and a bonus game outcome. The bonus game outcome may only be available when a base game results in an award of a bonus game. As an example, a bonus game can be initiated based on the base game outcome. In one example, if three of a predefined indicia 242 are visible in a base game outcome of the wagering game, a bonus game may be initiated.

When a wheel-based gaming feature starts, the game application 227 can render a user interface for selection of one or more previously awarded digital tokens. In some embodiments, one or more digital tokens can be determined that are associated with a current gaming session. The game application 227 can add digital tokens to a queue in memory between wheel-based gaming features. The game application 227 can query the gaming service 212 to determine the digital tokens 221 available in a patron account associated with the gaming device 103.

The game application 227 can render a user interface to facilitate a skill-based input. The user interface can include a digital representation of a physical environment, such as, for example, an environment including a slingshot, a gun, a character throwing, a character kicking, a rocket, or some other contraption. A skill-based input can be used to interact with the physical environment to launch the digital token toward a wheel 109. As an example, the patron can pull down on the digital token positioned in a slingshot via a touch screen using a finger. The patron can remove the finger to launch the digital token. In some embodiments, the user interface facilitates setting various other settings, such as, for example, an angle of inclination to launch the digital token. A direction and speed of the digital token can be based on a position of the finger when the finger was removed.

The game application 227 can determine a location on the wheel 109 based on the skill-based input. In some embodiments, the game application 227 can calculate a trajectory for the digital token to determine a landing position for the digital token. As an example, the game application 227 can determine a speed of the digital token and a direction based on the skill-based input. The game application 227 can calculate the trajectory based on the following formula:

$$y = x \tan\theta - \frac{gx^2}{2v_0^2 \cos^2\theta},$$

where θ is the angle of inclination, $v_0$ is the velocity, g is gravity, y is the vertical position and x is the horizontal position. By solving for a positive x value where y=0, the game application 227 can determine the landing point. The ranges of velocity and angle can be configured to adjust the amount of skill required to hit the wheel 109.

In other embodiments, the game application 227 can determine a landing spot using relative ranges of values. The values available for the inputs can be mapped to the wheel 109. As an example, a minimum pull back on a slingshot can cause the digital token to land just short of the wheel 109, while a maximum pull back on the slingshot can cause the digital token to land just past the wheel 109. Similarly, setting the angle to the maximum angle to a right side can result in missing the wheel 109 to the right and a maximum angle to a left side can result in missing the wheel 109 to the left. In another embodiment, the patron will automatically hit the wheel 109, and the skill-based input only determines where the digital token will hit the wheel 109.

The game application 227 can modify one or more aspects of a wheel-based gaming feature based on landing locations of one or more digital tokens. As an example, an indicia can be selected when a digital token lands on the indicia on the wheel based game. An aspect of the indicia can be modified based on the selection.

The game application 227 can move one or more digital tokens based on calculated physics when the wheel moves. As an example, during a spin of the wheel of the wheel-based gaming feature, the game application 227 can move a position of a digital token outward toward an edge of the wheel.

Figure 2B:
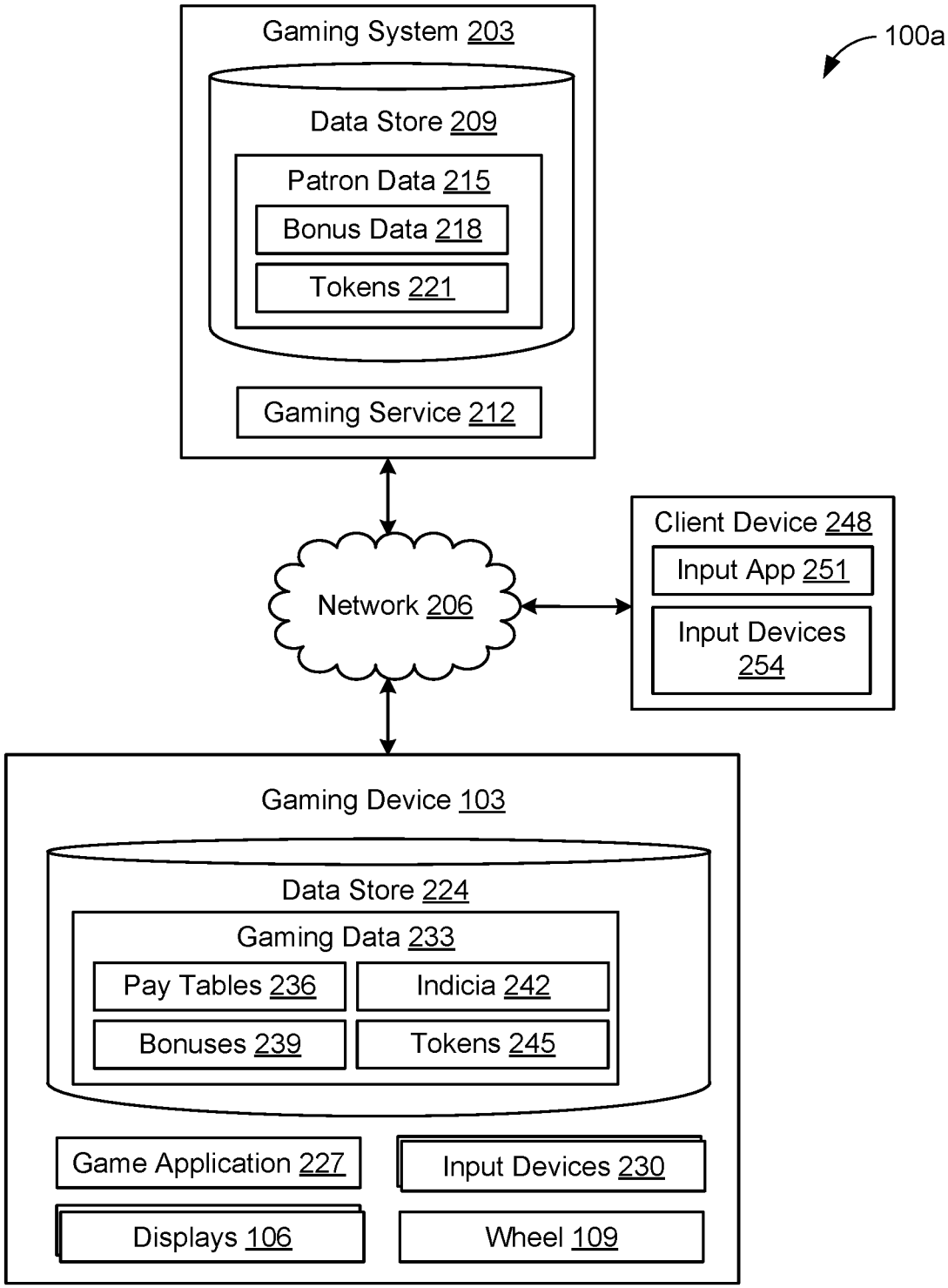
FIG. 2B is a diagram of another example gaming environment according to various embodiments of the present disclosure.

With reference to FIG. 2B, shown is a gaming environment 100*a* according to various embodiments of the present disclosure. The gaming environment 100*a* represents a gaming environment 100 except that a client device 248 is used to input a skill-based input. The client device 248 can communicate with the gaming device 103 via the network 206. As an example, the client device 248 can execute an input app 251 that can send and receive messages with the game application 227. In some embodiments, the client device 248 can be paired with the gaming device 103 via Bluetooth, near-field communication (NFC), or some other network 206. In other embodiments, a slot machine interface board (SMIB) can be located within the gaming device 103. The client device 248 can communicate via the network 206 with the SMIB in the gaming device 103. As an example, the client device 248 can pair with the SMIB, and the SMIB can communicate commands or messages to the gaming device 103.

The client device 248 is representative of a plurality of client devices that may be coupled to gaming device 103 via the network 206. The client device 248 can include, for example, a processor-based system such as a cell phone, a tablet, a smart phone, a smartwatch, or other processor-based device. Such a processor-based system may be embodied in the form of a smart phone, a tablet, a laptop computer, personal digital assistants, cellular telephones, music players, web pads, game consoles, electronic book readers, or other devices with like capability. The client device 248 can include a display, one or more input devices 254, a network interface, an input app 251, and various other components. The display can include, for example, one or more devices, such as liquid crystal display (LCD) displays, gas plasma-based flat panel displays, organic light emitting diode (OLED) displays, electrophoretic ink (E ink) displays, LCD projectors, or other types of display devices, etc.

The client device 248 can be configured to execute various applications such as the input app 251 and/or other applications. The input app 251 can receive the skill-based input via one or more input devices 254. The input app 251 can send the skill-based input to the game application 227. The input devices 254 are similar to the input devices 230 except located on the client device 248. When a wheel-based gaming feature is awarded, the game application 227 can render instructions to enter a skill-based input using the client device 248. Similar to the game application 227, the input app 251 can render contraptions or mechanisms on a display of the client device 248 to facilitate entry of the skill-based input. The input app 251 can determine one or more properties of the skill-based input and send the properties to the game application 227 via the network 206.

Figure 3:
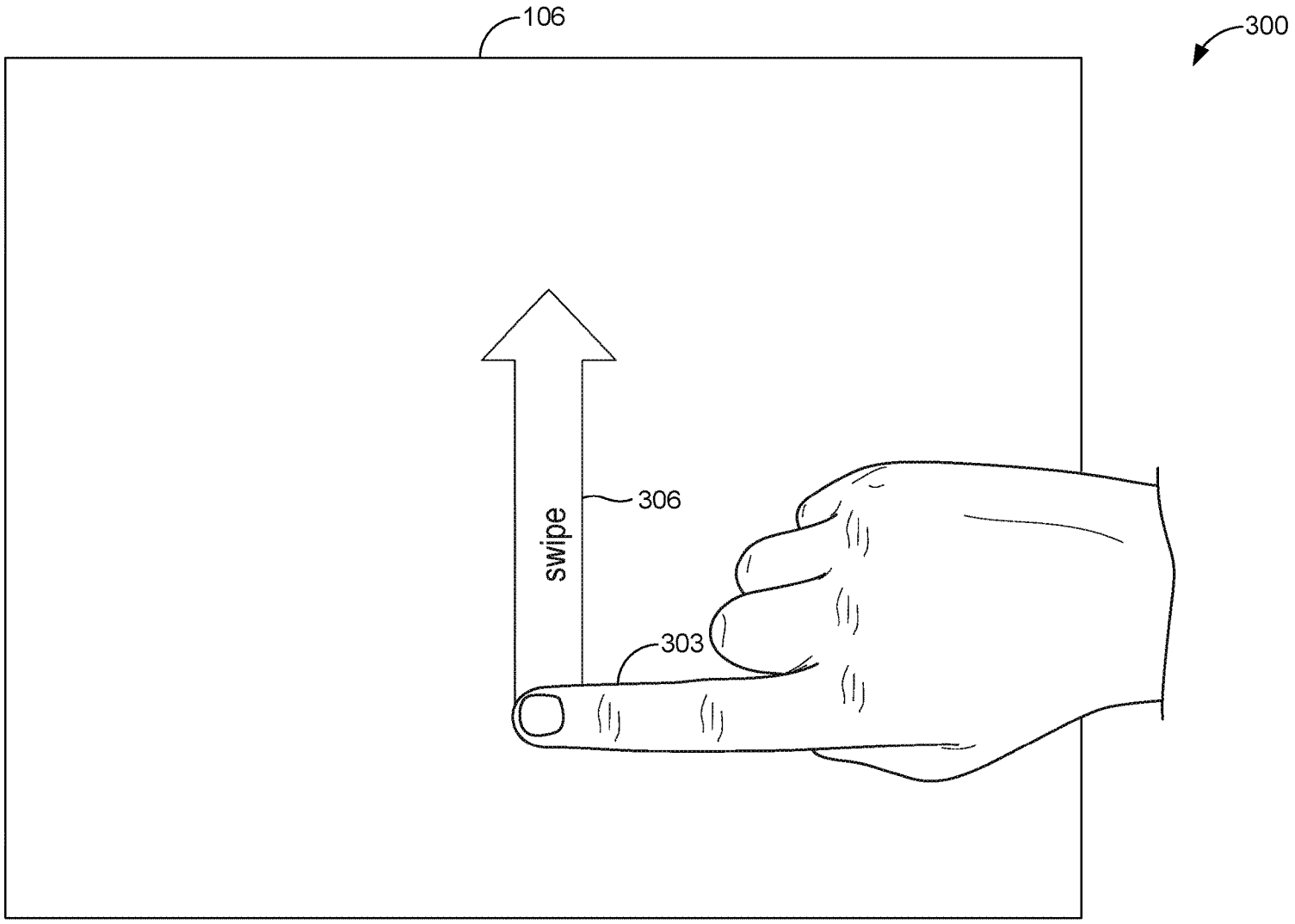
FIG. 3 is an illustration of a display of the gaming environment according to various embodiments of the present disclosure.

Turning to FIG. 3, shown is an illustration 300 of an example skill-based input on a display 106 according to various embodiments of the present disclosure. The illustration 300 includes a finger 303 of a patron providing a skill-based input by swiping on a display 106. The game application 227 can determine a speed and direction of the swipe. The game application 227 can render an area on the display 106 for a patron to swipe. The area can include an indicator 306 for an optimal direction. As an example, if the finger 303 moves central to and parallel to the indicator 306, the game application 227 can determine a digital token 112 (FIG. 1) lands along a vertical line centered on the wheel 109 (FIG. 1) of the wheel-based gaming feature.

In some embodiments, one or more environmental factors can be illustrated on the display. As an example, the game application 227 can render an instruction indicating a wind blowing from right to left at 5 miles per hour. The game application 227 can cause the digital token 112 to drift toward the left based on the wind. In one embodiment, swipe is received via a client device 248 (FIG. 2B). As an example, a patron can swipe a finger 303 on a touch screen of a client device 248 paired with the gaming device 103.

Figure 4:
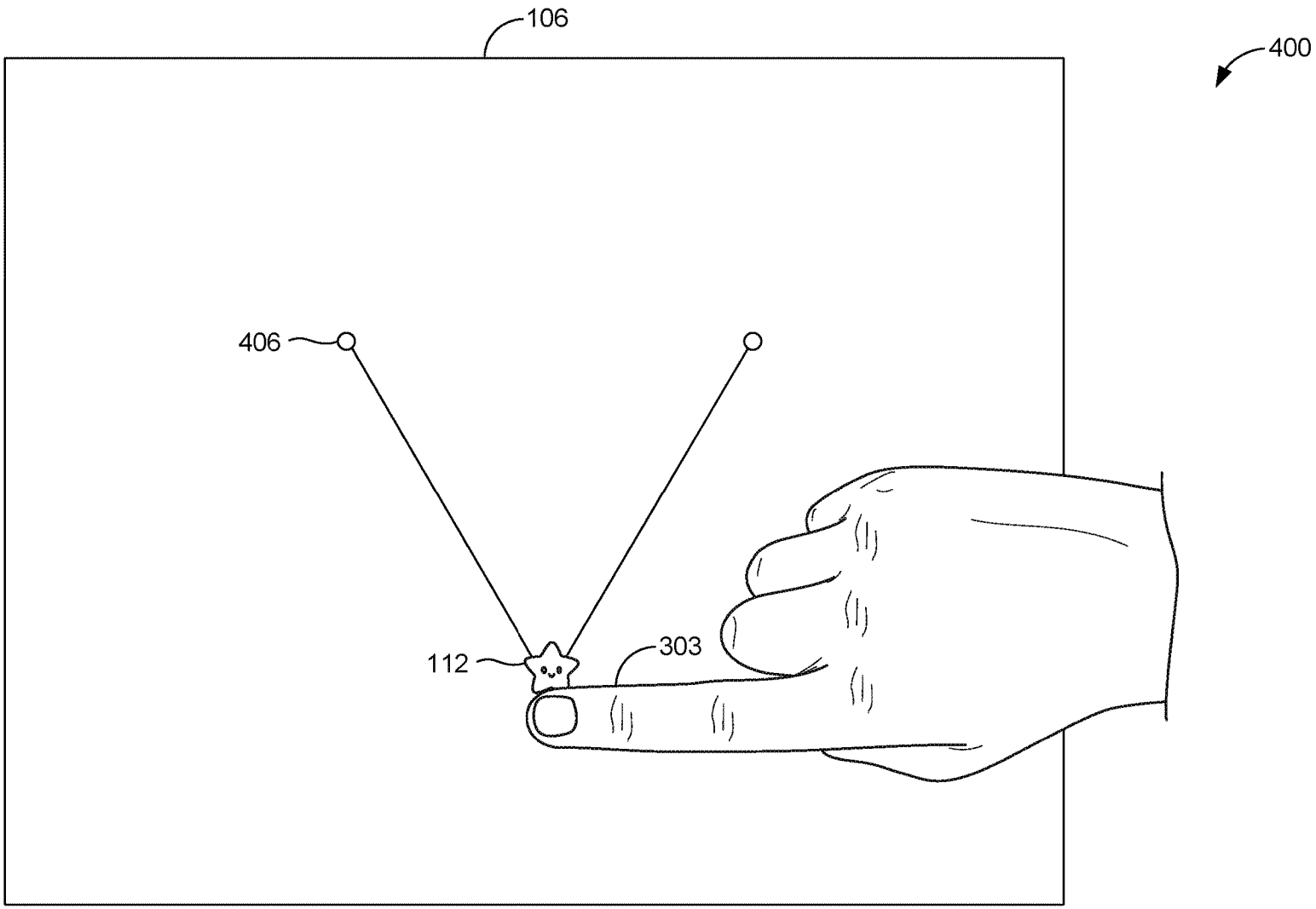
FIG. 4 is an illustration of a display of the gaming environment according to various embodiments of the present disclosure.

With reference to FIG. 4, shown is an illustration 400 of an example skill-based input on a display 106 according to various embodiments of the present disclosure. The illustration includes a finger 303 of a patron providing a skill-based input by pulling the finger 303 down to pull back a slingshot 403. The finger 303 can contact a touch screen of the display 106 proximate to a digital token 112. The finger 303 can pull downward to move the digital token 112 within the slingshot 403 downward. By pulling the finger 303 away from the touch screen, the digital token 112 can be released to launch from the slingshot.

The game application 227 can determine a speed and direction for the digital token 112 based on the skill-based input. The digital token 112 can be pulled downward a variable distance in the slingshot 406. The speed of the digital token 112 can be determined based on the variable distance the slingshot 406 stretched when the slingshot is released. A direction of the digital token 112 can be based on a position of the digital token 112 on a horizontal axis when the slingshot 406 is released. As an example, if the digital token 112 is positioned directly between the two points of the slingshot 406, the game application 227 can determine the digital token 112 lands along a vertical line centered on the wheel 109 (FIG. 1) of the wheel-based gaming feature. In one embodiment, the slingshot 406 is rendered on a touch screen of a client device. An application executed by the client device can communicate the skill-based input to the game application 227.

Figure 5:
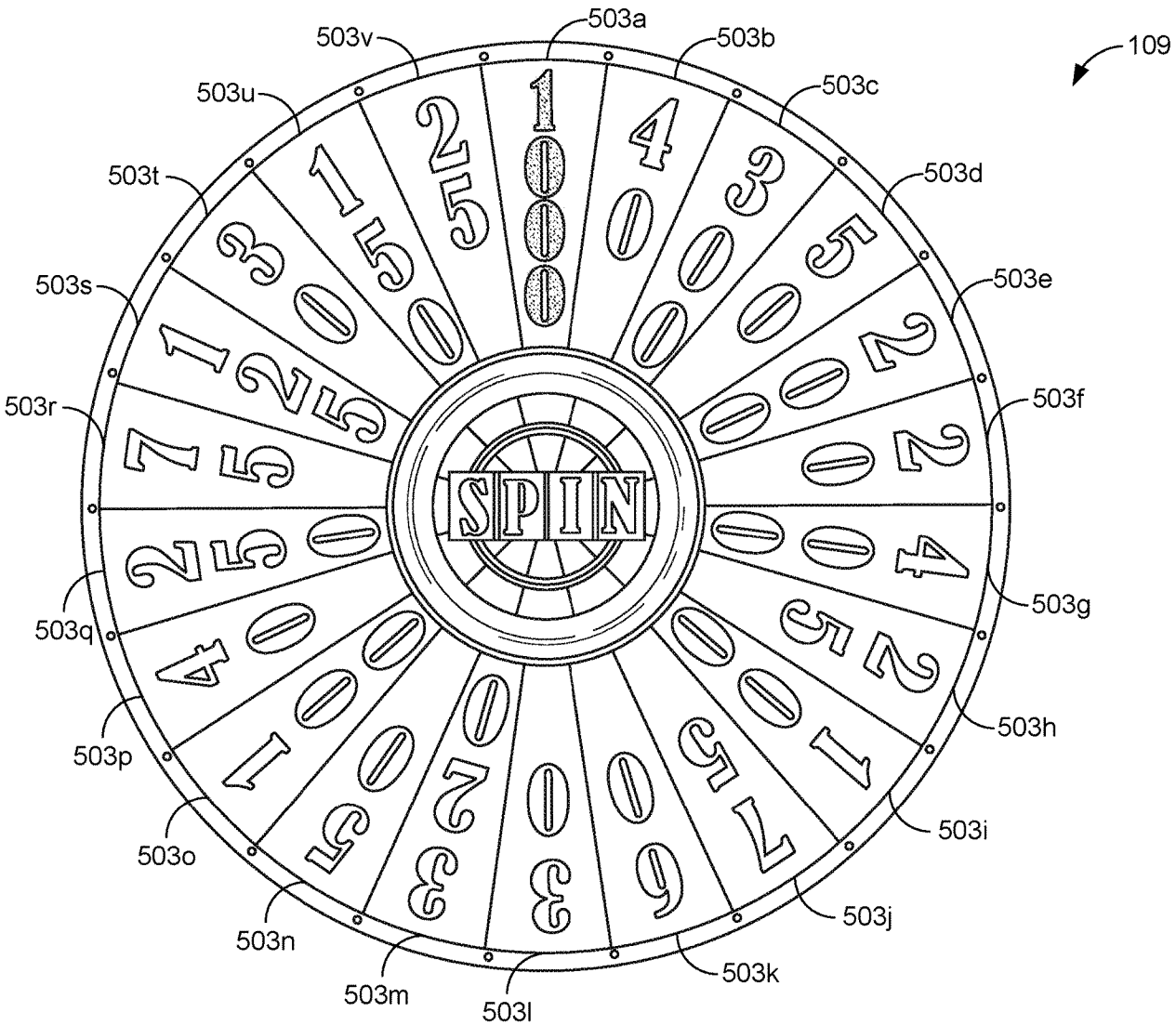
FIG. 5 is an illustration of an example wheel in the gaming environment according to various embodiments of the present disclosure.

With reference to FIG. 5, shown is a wheel 109 according to various embodiments of the present disclosure. The wheel 109 includes one or more indicia 503*a-v*. During a wheel-based gaming feature, the game application 227 can spin the wheel 109. An indicia 503 aligned with predetermined position can be selected as an award. As an example, if the indicia 503*a* is aligned with the predetermined position when the wheel 109 stops, the game application 227 can credited with 1000 credits.

A value can be associated with each indicia 503*a-v*. In some embodiments, the value can correspond to a negative value or a prize. When a negative value is awarded, the game application 227 can deduct from the total game credits. If a prize is selected, a casino can provide the prize to the patron. As an example, the prizes can include a teddy bear, an automobile, a flower, or some other prize.

The aspect being modified can include altering a size of one or more indicia 503. An indicia 503 that the digital token 112 lands on can be reduced or increased in size. In one embodiment, a size of an indicia 503 is doubled when a particular type of digital token 112 lands on the indicia 503. The aspect can include changing a position of one or more indicia 503. As an example, a digital token 112 can land on an indicia 503*a*, and the game application 227 can switch the indicia 503*a* with 503*l*. The digital token 112 can be launched when the wheel 109 is stationary. After the digital tokens 112 are in place, the spinning of the wheel 109 can occur. In some embodiments, the digital tokens 112 can be launched onto the wheel 109 during a base game. As an example, when an outcome of the wagering game indicates a digital token 112 is awarded, the digital token 112 can be launched onto the wheel 109 and the patron can continue playing the wagering game. In this example, when the wheel-based gaming feature is activated, any digital tokens 112 already located on the wheel 109 can modify aspects of the wheel-based gaming feature. In other embodiments, the digital tokens 112 can be launched while the wheel 109 is spinning. The difficulty of hitting a particular indicia 503 is increased if the wheel 109 is spinning when the launch occurs.

During a wheel-based gaming feature, the wheel 109 can have a period of time when the wheel 109 accelerates up to a spin velocity. Once up to the spin velocity, the wheel 109 can then decelerate until stopping with a pointer 506 indicating one of the indicia 503. The aspect being modified can include altering a spin rate of the wheel 109. In one embodiment, the wheel 109 can decelerate faster or slower when a particular digital token 112 lands anywhere on the wheel 109. In some embodiments, the wheel 109 can decelerate faster or slower while a pointer 506 is passing an indicia 503 that a particular digital token 112 is positioned on. Modifying the deceleration can also be referred to as altering the stopping force of the wheel 109. The deceleration of the wheel 109 can be affected by a stopping force. Similarly, the digital token 112 can increase or decrease the spin velocity or the acceleration up to the spin velocity. In one example, the digital token corresponds to a magnet character and the wheel 109 decelerates when a pointer 506 passes the indicia as if the indicia is a magnet attracting the pointer 506.

The aspect being modified can include alter a probability of the wheel 109 stopping at an indicia. Although a wheel 109 appears to have an equal probability of landing on each indicia 503, the resulting indicia 503 from the spin can be predetermined based on weighted probabilities. As an example, an indicia 503*r* can be determined prior to spinning the wheel 109, and the wheel 109 can be spun such that the pointer 506 ends on indicia 503*r*. A digital token 112 positioned on indicia 503*r* can cause the probability of landing on indicia 503*r* to be increased or decreased.

Some types of digital tokens 112 can be used to alter the functionality of the wheel-based game feature without being launched. The game application 227 can prompt a patron to select an indicia 503 when a particular type of digital token 112 is used. For one type of digital token 112, the selected indicia can be doubled in size. For another type of digital token, the game application 227 can prompt a user to select an indicia for which the probability of landing on the selected indicia becomes increased. The patron can select indicia 503*a* as being "sticky," and the probability of landing on 503*a* can be increased. For one type of digital token 112, a second pointer 506 can be awarded. The outcomes of the wager based game can be altered based on a patron exhibiting skill by strategically selecting when and where to use digital tokens 112.

The aspect being modified can include selecting a different indicia when the wheel lands on an indicia. As an example, when a pointer 506 lands on indicia 503*g* while a digital token 112 is positioned on 503*g*, a different indicia 503 can be selected. For one type of digital token 112, an indicia to the left or right can be selected, such as indicia 503*f* or 503*h*. In some embodiments, a patron can be provided an option to select either the right side or the left side when the patron has one type of digital token 112. For another type of digital token 112, an indicia on an opposite side can be selected, such as indicia 503*r*. The value of one or more indicia 503 can be increased or decreased.

The value can be altered by adding a multiplier to the value of the slice. As an example, a digital token 112 that lands on 503*d* can apply a 3*x* multiplier to increase the indicia 503*d* from 50 credits to 150 credits. As another example, the digital token 112 can cause a value of an indicia 503 to be randomly increased or decreased within a set range. The value of the indicia to can changed to award another spin of the wheel. A patron can be provided an option to re-spin when one type of digital token 112 is on the wheel 109, such as, for example, when an undesirable wheel outcome occurs. The value of the indicia can also be changed to award points to a patron account. The value of the indicia can be modified to award virtual currency. For one type of digital token 112, an indicia can be converted to wild. The wild indicia can correspond to a top award. For another type of digital token 112, the patron can be prompted to select an indicia to convert to a wild indicia.

When the skill-based input is received, the game application 227 can adjust a landing location of the digital token 112 to fall on a single indicia 503. As an example, the game application 227 can determine a trajectory of a digital token 112 intersects the wheel 109 on a border of indicia 503*g*. The digital token 112 can have a surface area that covers part of both indicia 503*g* and indicia 503*h*. The game application 227 can adjust the position of the digital token 112 such that the surface area of the digital token 112 is only on indicia 503*g*. The selection of indicia 503*g* can be based on the portion of the surface area for the digital token 112 being on indicia 503*g* exceeding the portion of the surface area for the digital token 112 being on indicia 503*h*. In another example, the trajectory of the digital token 112 can intersect the wheel 109 on a border of two indicia, such as a border of indicia 503*e* and 503*f*. The game application 227 can randomly select one of indicia 503*e* and 503*f* and move the digital token 112 such that the surface area of the digital token 112 is only on the selected indicia.

Figure 6:
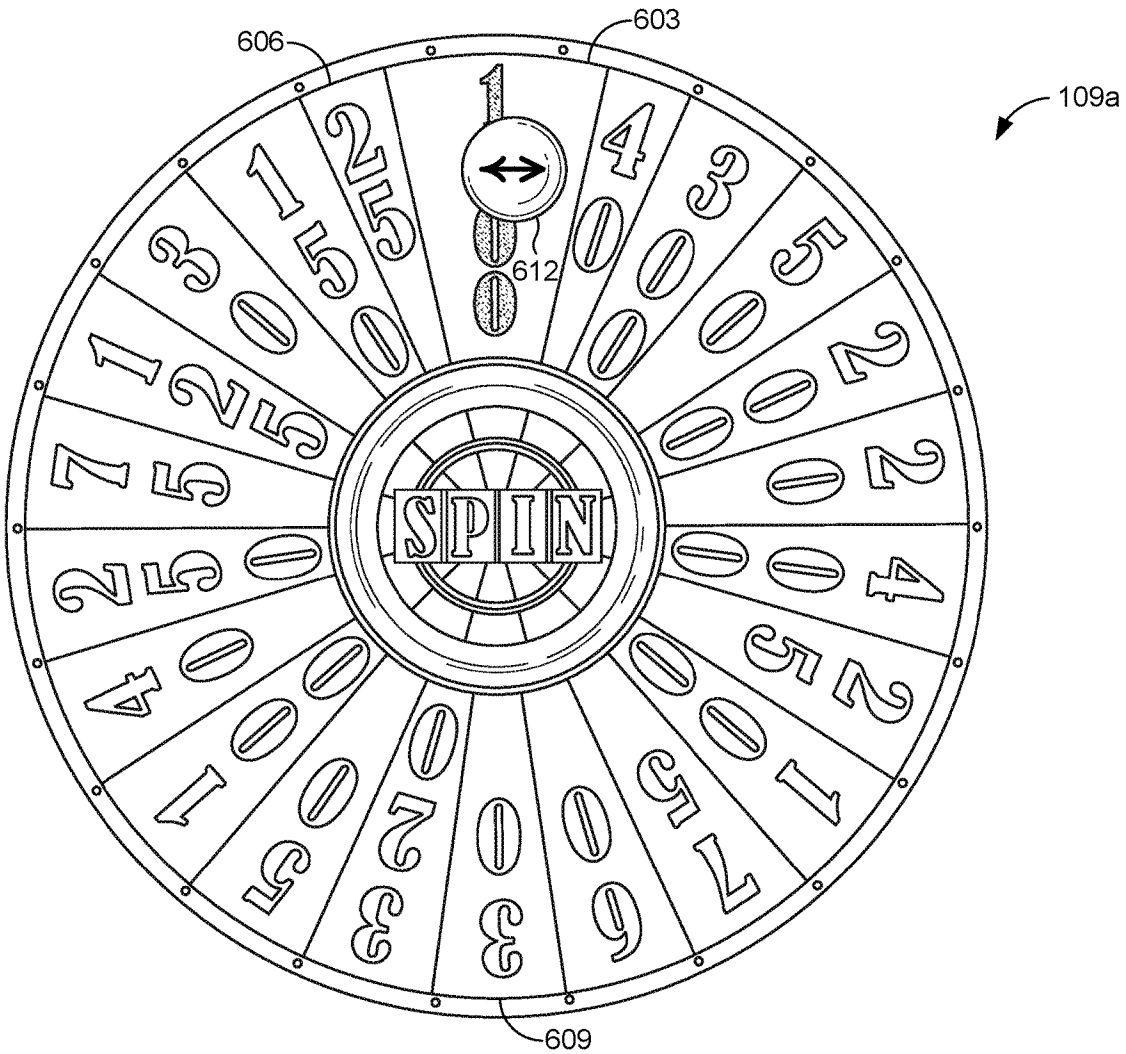
FIG. 6 is an illustration of another example wheel in the gaming environment according to various embodiments of the present disclosure.

With reference to FIG. 6, shown is a wheel 109*a* according to various embodiments of the present disclosure. In some embodiments, the wheel 109*a* can correspond to a wheel 109 (FIG. 5) after an example digital token is launched. The wheel 109*a* includes a plurality of indicia including indicia 603 and indicia 606. A digital token 612 is positioned on the indicia 603. The game application 227 (FIGS. 2A and 2B) can receive a skill-based input from an input device of the gaming device 103 (FIG. 1). The game application 227 can determine a position of the digital token 612 based on the skill-based input. As an example, the game application 227 can determine the digital token 612 lands on indicia 603 based on the skill-based input.

The game application 227 can modify an aspect of the wheel-based gaming feature depending on a type of the digital token 612 and a position of the digital token 612. As an example, the game application 227 can modify an aspect of indicia 603 based on the digital token 612 landing on the indicia 603. In some embodiments, other indicia can be modified based on landing on the indicia 603. For example, the game application 227 can modify an indicia 609 opposite the indicia 603 if the digital token 612 lands on the indicia 603.

A digital token can visually represent a type of digital token. As an example, the digital token 612 is a ball with a bi-directional arrow, which can correspond to an indicia widening type of digital token. The game application 227 can modify an aspect of the indicia 503*a* (FIG. 5) by increasing the width as shown in the indicia 603. A size of other indicia can decrease to accommodate the increase in size. In one embodiment, the size of surrounding indicia, such as indicia 606, can be decreased to accommodate the increase in size of the indicia 603. In other embodiments, a size of all of the indicia in the wheel 109*a* can be decreased equally to accommodate the increase in size of the indicia 603.

Figure 7:
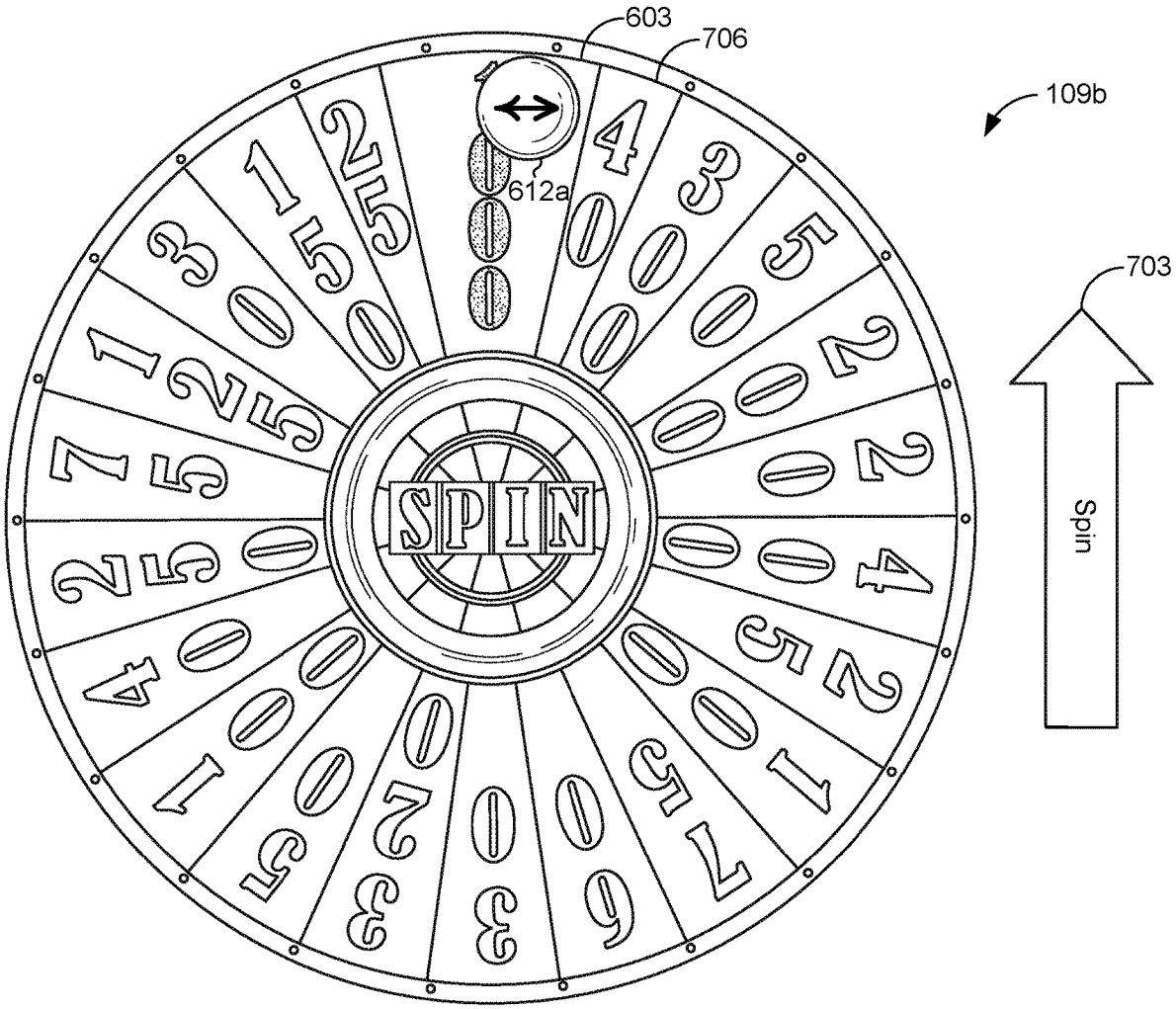
FIG. 7 is an illustration of another example wheel in the gaming environment according to various embodiments of the present disclosure.

With reference to FIG. 7, shown is a wheel 109*b* according to various embodiments of the present disclosure. In some embodiments, the wheel 109*b* can correspond to wheel 109*a* (FIG. 6) after a spin 703 of the wheel 109*a*. The wheel 109*b* includes a plurality of indicia including indicia 603 and indicia 706. A digital token 612*a* is positioned on the indicia 603. The game application 227 (FIGS. 2A and 2B) can simulate a rotational force on the digital token 612 (FIG. 6) generated by spinning the wheel 109*a* to move the digital token 612 wheel 109*a* spins. The spin 703 can move the digital token 612 outward on the wheel 109*b* to the position of digital token 612*a*. The digital token 612*a* can also move toward the indicia 706 based on a force caused by the initial acceleration of the wheel 109*b* during the spin 703.

In some embodiments, different digital tokens can react differently to the rotational force when the wheel 109*a* spins. As an example, one digital token can be considered heavier than another digital token. The heavier digital token may move slower than the lighter digital token or may not move at all. As another example, a friction value associated with one digital token may be higher than a friction value associated with another. The higher friction digital token may require a faster spin of the wheel 109*a* to begin moving. For example, the wheel 109*a* may spin faster when a digital token positioned on the wheel 109*a* increases the speed of the wheel 109*a*.

When two or more digital tokens are located on the wheel 109*a*, the digital tokens may collide. As an example, the digital tokens may move during the spin of the wheel 109*a* and collide during that movement. The game application 227 can determine a collision of a first digital token with a second digital token. The game application 227 can adjust a path of the first and second digital token when the collision takes place. As an example, the game application 227 can determine a momentum vector for each digital token based on a preconfigured weight and determined velocity of each digital token. The momentum vectors can be used to adjust the velocity and direction of movement for each digital token.

When a digital token is moved off of the wheel 109*a*, the game application 227 can reverse the aspect modified by the digital token. For example, if the game application 227 doubled the size of an indicia based on a digital token, the game application 227 can reverse the size of the indicia back to an original size if the digital token falls off the wheel 109*a*.

Figure 8:
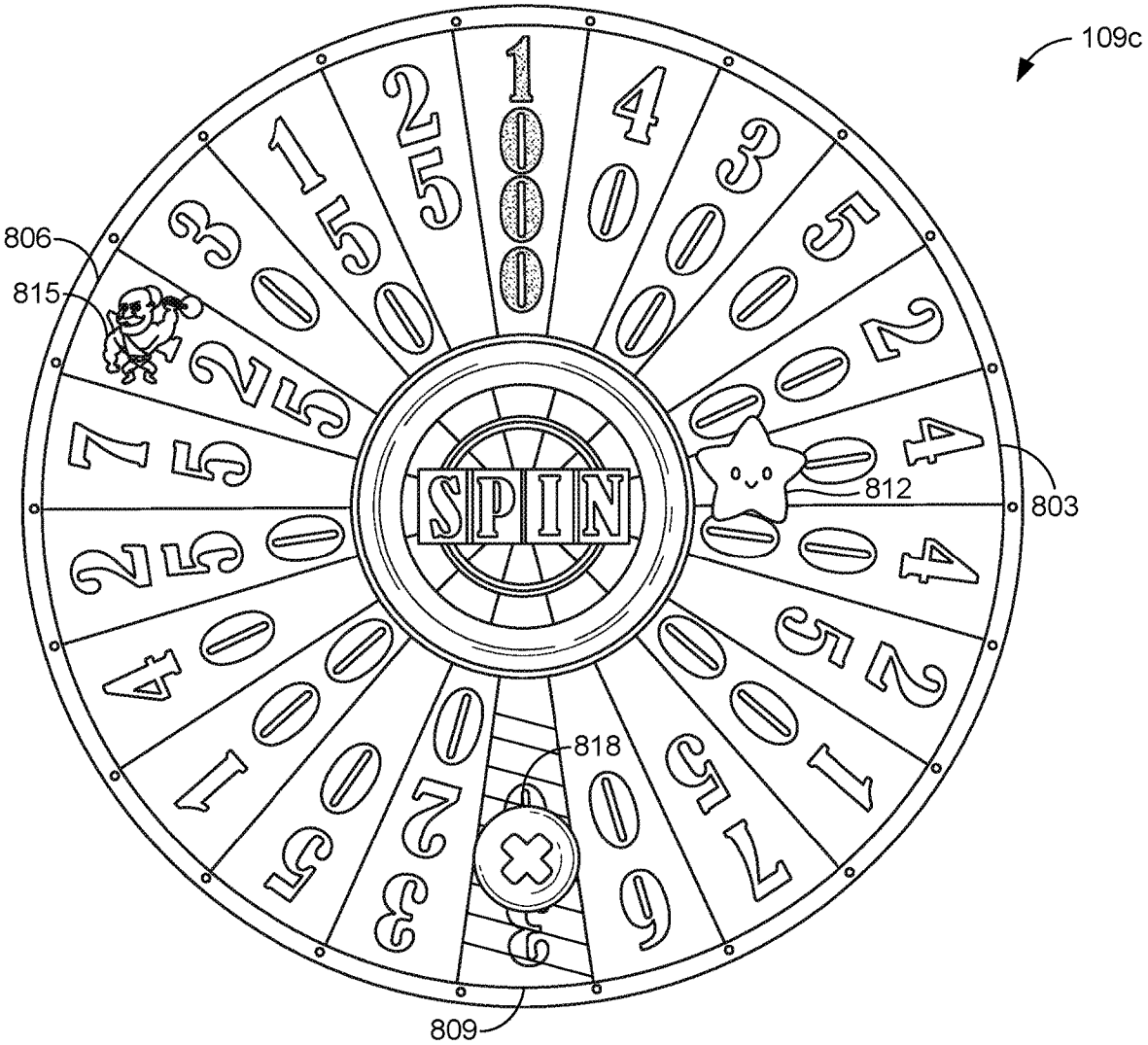
FIG. 8 is an illustration of another example wheel in the gaming environment according to various embodiments of the present disclosure.

Turning to FIG. 8, shown is a wheel 109*c* according to various embodiments of the present disclosure. According to some embodiments, the wheel 109*c* can correspond to a wheel 109 (FIG. 5) after multiple example digital tokens are launched. The wheel 109*c* includes a plurality of indicia including indicia 803, 806, and 809. The wheel 109*c* also includes digital tokens 812, 815, and 818.

The game application 227 can facilitate launching of one or more digital tokens during a wheel-based gaming feature, such as digital tokens 812, 815, and 818. Each of the digital tokens can correspond to a type of digital token. The digital token 812 can be a star type, a strength type, or a deactivate type. The type of digital token can affect the aspect of the wheel-based gaming feature that is modified or how each digital token alters or modifies an aspect of the wheel-based gaming feature. As an example, the digital token 812 can cause a speed of the wheel 109*c* to increase while a pointer 506 passes over the indicia 803. As another example, the digital token 812 can cause a deceleration of the spin of the wheel 109*c* to decrease while passing over the indicia 803.

The game application 227 can simulate physics when the digital tokens are launched. As an example, a launched digital token can contact the digital token 812 when it lands. The launched digital token can push the digital token 812 when the contact occurs. In one example, the digital token 812 can be moved to another indicia. In another example, the digital token 812 can be pushed off of the wheel 109*c*.

In some embodiments, the game application 227 can animate the digital token 815 to grab onto an outer edge of the wheel 109*c* to stop the wheel while spinning. In another embodiment, the digital token 815 can slow down the wheel while the indicia 806 passes over a pointer 506. The digital token 818 can disable the indicia 809. When the indicia 809 is disabled, the probability that the game application 227 stops the wheel 109*c* awarding the indicia 809 becomes zero.

Figure 9:
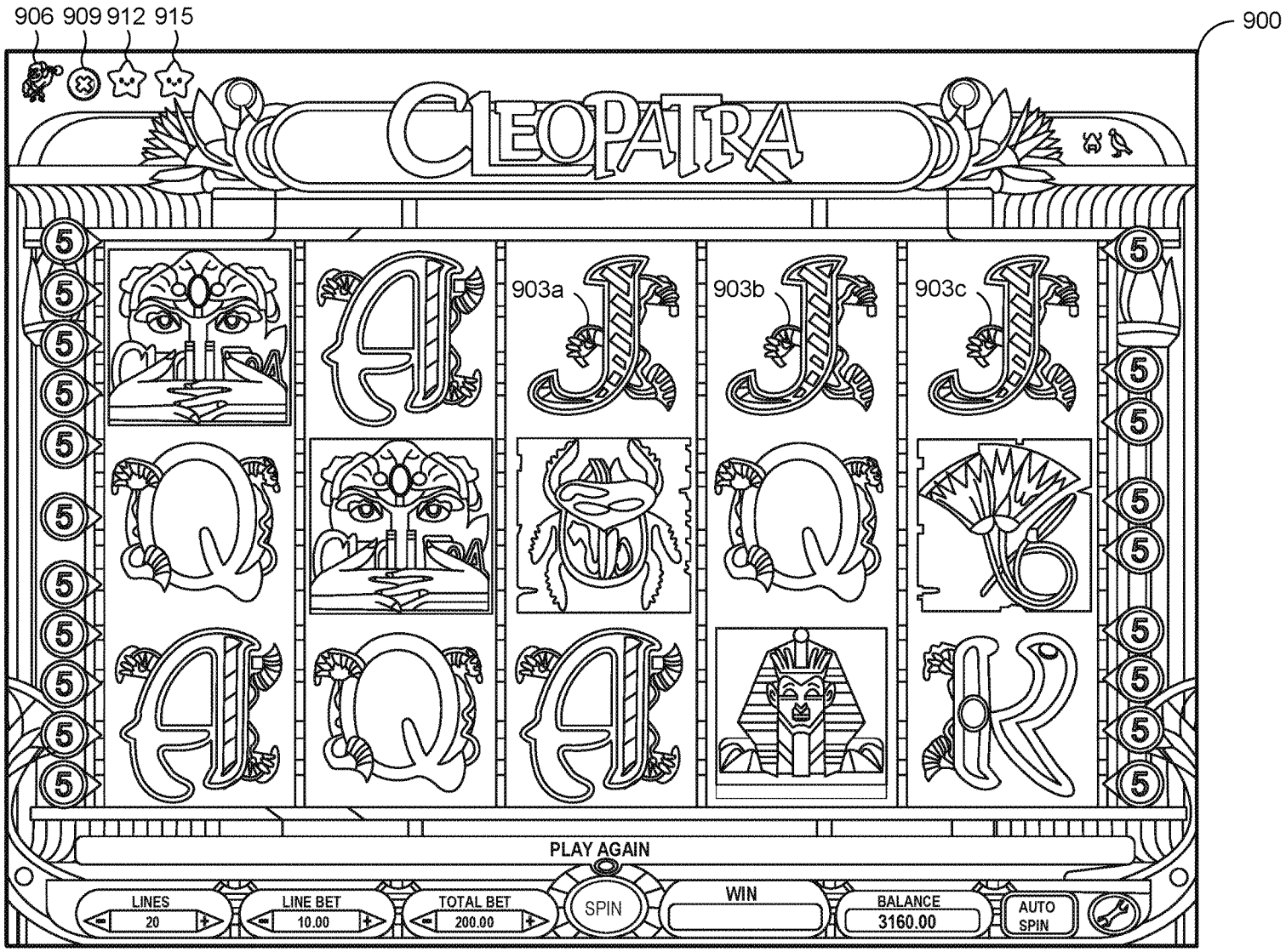
FIG. 9 is an illustration of user interface rendered on a display of a gaming device in the gaming environment according to various embodiments of the present disclosure.

Turning to FIG. 9, shown is an illustration of a user interface 900 rendered on a display 106 (FIG. 1) according to various embodiments of the present disclosure. The user interface 900 can include a plurality of indicia including indicia 903*a*, 903*b*, and 903*c*. The user interface 900 can also include one or more digital tokens awarded to a patron, such as digital tokens 906, 909, 912, and 915. The game application 227 can award one or more digital tokens based on an outcome of the wagering game. In one example embodiment, when a game outcome includes the indicia 903*a*, 903*b*, and 903*c* on a payline, the game application 227 can award a digital token. In some embodiments, different game outcomes in a pay table 236 (FIGS. 2A and 2B) correspond to different types of digital tokens. In other embodiments, a digital token is randomly selected when a pay table 236 indicates that a digital token is to be awarded. In yet another embodiment, the game application 227 renders multiple selectable options corresponding to different digital tokens, and a patron can select one of the options without knowing which type each option corresponds to.

In some embodiments, a patron can purchase one or more digital tokens 112. Different types of digital tokens 112 can have different costs. As one example, a magnet digital token can costs $1.00 while a multiplier digital token can cost $3.00. In one embodiment, the game application 227 can provide a puzzle to solve during a base game. The digital tokens 112 can be awarded when the puzzles are solved.

After a digital token is awarded, the digital token can be added to the digital tokens 221 (FIGS. 2A and 2B) associated with a patron account. When a wheel-based gaming feature is awarded, the game application 227 can facilitate selecting one or more of the queued digital tokens 221. The patron can provide skill-based inputs to launch the selected one or more digital tokens toward a wheel 109 (FIG. 1) to modify one or more aspects of the wheel-based gaming feature. Once a digital token is launched in a wheel-based gaming feature, the digital token is removed from the digital token 221. The digital tokens 906, 909, 912, and 915 can be removed from the user interface 900 when the digital tokens are launched in a wheel-based gaming feature.

In some embodiments, the digital tokens 112 can alter the game play of a base game. As an example, the digital tokens 112 can be launched at the reel in user interface 900 and land on one of the indicia 903. One of more aspects of the indicia 903 can be altered as described herein. As another example, different types of digital tokens 112 can be used to award a free spin, nudge a reel, increase the probability of a wild symbol being selecting during game play, randomly replace indicia 903 with wild symbols, double line wins, add additional pay lines, or alter other functionality.

Figure 10:
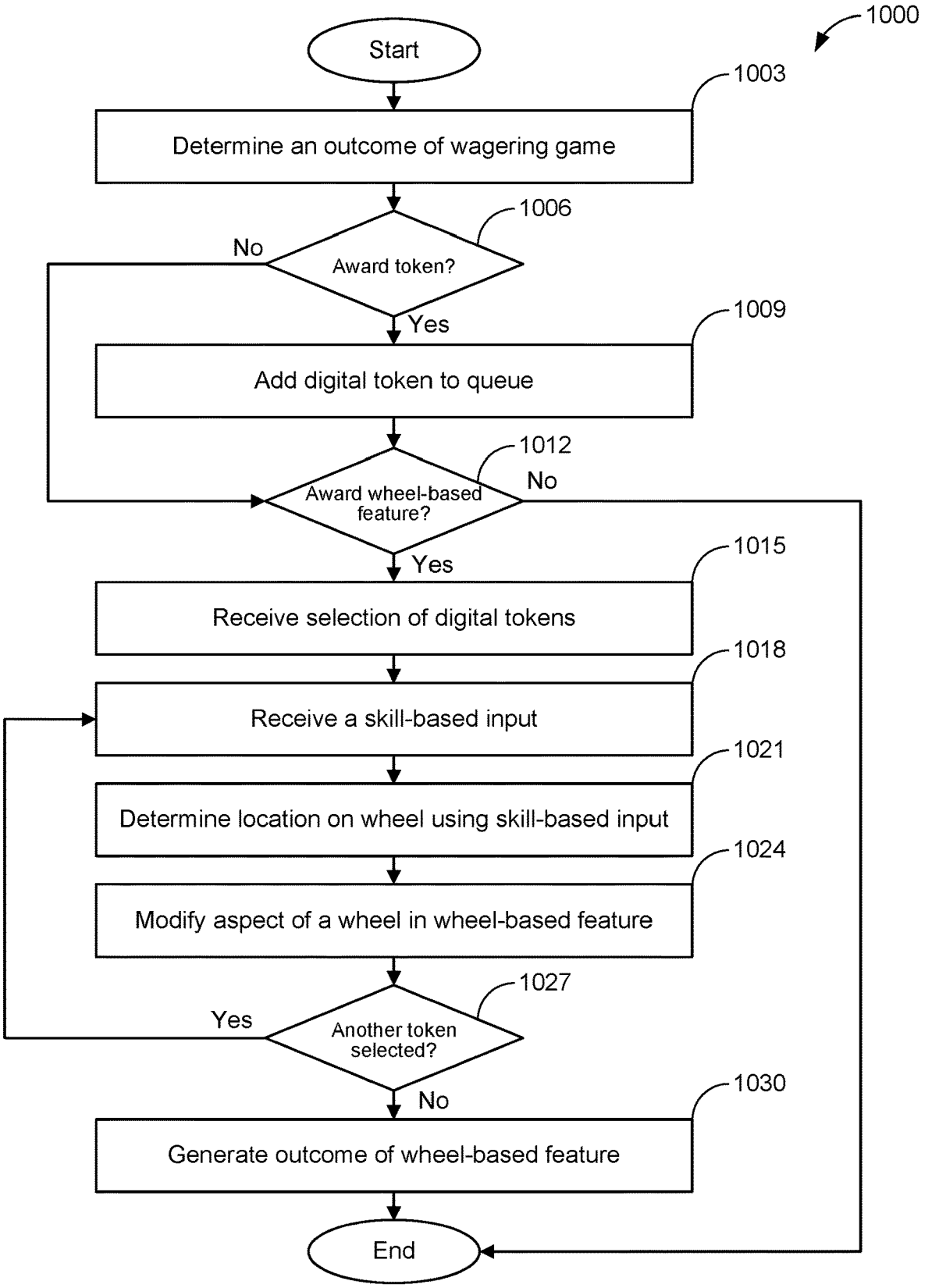
FIG. 10 is a flowchart illustrating one example of functionality implemented as portions of the game application executed in a gaming device in the gaming environment of FIG. 1 according to various embodiments of the present disclosure.

Referring next to FIG. 10, shown is a flowchart of a process 1000 that provides one example of the operation of a portion of the game application 227 (FIGS. 2A and 2B) according to various embodiments. It is understood that the flowchart provides merely an example of the many different types of functional arrangements that may be employed to implement the operation of the portion of the game application 227 as described herein. As an alternative, the flowchart may be viewed as depicting an example of elements of a method implemented in the gaming environment 100 (FIG. 1) according to one or more embodiments.

Beginning with box 1003, the process 1000 involves determining an outcome of a wagering game. For example, the game application 227 can initiate the reels of a slot machine. The game application 227 can determine the outcome based on a pay table 236 (FIGS. 2A and 2B). As an example, if a pay line on a set of reels ends for a wagering game with a certain combination that matches an outcome in the pay table 236, the outcome can be awarded.

At box 1006, the process 1000 involves determining whether the outcome of the wagering game awards a digital token. For example, the game application 227 can compare the outcome of the wagering game to the pay table 236 to determine whether one or more digital tokens should be awarded. If a digital token is awarded, the process 1000 proceeds to box 1009. Otherwise, the process proceeds to box 1012.

At box 1009, the process 1000 involves adding the one or more digital tokens awarded to a queue. As an example, the game application 227 can add the digital tokens to data corresponding to a current gaming session. As another example, the game application 227 can send information describing the digital tokens to the gaming service 212 (FIGS. 2A and 2B), and the gaming service 212 can add the digital tokens to digital tokens 221.

At box 1012, the process 1000 involves determining whether a wheel-based gaming feature is awarded. The game application 227 can determine whether the outcome includes an award of a wheel-based gaming feature based on the pay table 236. If a wheel-based gaming feature is awarded, the process 1000 proceeds to box 1015. Otherwise, process 1000 ends.

At box 1015, the process 1000 involves receiving a selection of one or more digital tokens. As an example, the game application 227 can render an interface to facilitate selection of one or more digital tokens queued in box 1009. In some embodiments, all queued digital tokens are automatically selected. In other embodiments, one or more of the digital tokens are randomly selected from the queue.

At box 1018, the process 1000 involves receiving a skill-based input via one or more input devices. As an example, the game application 227 can render a contraption or mechanism on the display 106. The game application 227 can receive an input from a patron to participate in the skill-based feature of the wagering game. The input can include a touch screen based interaction with a contraption or mechanism rendered on the display 106. The game application 227 can determine several properties associated with the skill-based input. As an example, the game application 227 can determine a speed and duration of the input, a path of one or more touch inputs, a force of the input, and other properties. The game application 227 can measure a force of the input based on a pressure sensor or using three-dimensional touch technology to determine how much pressure is received for the input.

At box 1021, the process 1000 involves determining a location on the wheel based on the skill-based input. As an example, the game application 227 can determine a location on the wheel 109 using the skill-based input from box 1018. The game application 227 can calculate a trajectory of the digital token to determine a landing location based on the properties of the skill-based input.

At box 1024, the process 1000 involves modifying one or more aspects of a wheel in the wheel-based gaming feature. For example, the game application 227 can alter an aspect of the wheel 109 based on the location the digital token lands on the wheel 109. The game application 227 can alter a size of one or more indicia, change a position of one or more indicia, change a spin rate of the wheel 109, alter a stopping force of the wheel 109, alter a probability of the wheel 109 stopping at one or more indicia, slow down the wheel 109 while over one or more, speed up the wheel 109 while over one or more indicia, select a different indicia when the wheel 109 lands on one or more indicia, and alter an award of winning one or more indicia, among other modifications. In some embodiments, if the landing location of the digital token is not on the wheel 109, no aspects of the wheel 109 are modified. In other embodiments, the game application 227 randomly selects one or more aspects to modify in the wheel-based gaming feature.

At box 1027, the process 1000 involves determining whether another digital token is selected. As an example, the game application 227 can iterate through each digital token selected in box 1015. During each iteration, the game application can receive a skill-based input, determine a location on the wheel 109, and modify the wheel 109 based on the landing location. If another digital token is selected, the process 1000 moves to box 1018. Otherwise, the process 1000 proceeds to box 1030.

At box 1030, the process 1000 involves generating an outcome of the wheel-based gaming feature. As an example, the game application 227 can spin the wheel 109. An outcome of the wheel-based gaming feature can be awarded based on an indicia located at a predefined position. A pointer 506 can point to the predefined position. The outcome of the wheel-based gaming feature can be modified based on the digital tokens. As an example, an indicia opposite an indicia located at a predefined position can be awarded based on a specific type of digital token being positioned on the indicia located at the predefined position.

The flowchart of FIG. 10 shows an example of the functionality and operation of implementations of components described herein. The components described herein can be embodied in hardware, software, or a combination of hardware and software. If embodied in software, each element can represent a module of code or a portion of code that includes program instructions to implement the specified logical function(s). The program instructions can be embodied in the form of, for example, source code that includes human-readable statements written in a programming language, or machine code that includes machine instructions recognizable by a suitable execution system, such as a processor in a computer system or other system. If embodied in hardware, each element can represent a circuit or a number of interconnected circuits that implement the specified logical function(s).

Although the flowchart shows a specific order of execution, it is understood that the order of execution can differ from that which is shown. For example, the order of execution of two or more elements can be switched relative to the order shown. Also, two or more elements shown in succession can be executed concurrently or with partial concurrence. Further, in some examples, one or more of the elements shown in the flowchart can be skipped or omitted.

The gaming device 103, the game system 203, the client devices 248, or other components described herein can include at least one processing circuit. Such a processing circuit can include, for example, one or more processors and one or more storage devices that are coupled to a local interface. The local interface can include, for example, a data bus with an accompanying address/control bus or any other suitable bus structure.

The one or more storage devices for a processing circuit can store data or components that are executable by the one or more processors of the processing circuit. For example, the gaming service 212, game application 227, input app 251, and/or other components can be stored in one or more storage devices and be executable by one or more processors. The data stored in the storage devices can be encrypted to prevent tampering. The data can also be hashed such that a subsequent hash can be performed to determine if the data has been modified. Also, a data store 209 or 224 can be stored in the one or more storage devices.

The gaming service 212, game application 227, input app 251, and/or other components described herein can be embodied in the form of hardware, as software components that are executable by hardware, or as a combination of software and hardware. If embodied as hardware, the components described herein can be implemented as a circuit or state machine that employs any suitable hardware technology. The hardware technology can include, for example, one or more microprocessors, discrete logic circuits having logic gates for implementing various logic functions upon an application of one or more data signals, application specific integrated circuits (ASICs) having appropriate logic gates, programmable logic devices (e.g., field-programmable gate array (FPGAs), and complex programmable logic devices (CPLDs)).

Also, one or more or more of the components described herein that include software or program instructions can be embodied in any non-transitory computer-readable medium for use by or in connection with an instruction execution system such as a processor in a computer system or other system. The computer-readable medium can contain, store, and/or maintain the software or program instructions for use by or in connection with the instruction execution system.

A computer-readable medium can include a physical media, such as magnetic, optical, semiconductor, and/or other suitable media. Examples of a suitable computer-readable media include, but are not limited to, solid-state drives, magnetic drives, or flash memory. Further, any logic or component described herein can be implemented and structured in a variety of ways. For example, one or more components described can be implemented as modules or components of a single application. Further, one or more components described herein can be executed in one computing device or by using multiple computing devices.

It is emphasized that the above-described examples of the present disclosure are merely examples of implementations to set forth for a clear understanding of the principles of the disclosure. Many variations and modifications can be made to the above-described examples without departing substantially from the spirit and principles of the disclosure. All such modifications and variations are intended to be included herein within the scope of this disclosure.

The invention claimed is:

1. A system comprising:

at least one display;

at least one sensor, and at least one computing device communicatively coupled to the at least one display and the at least one sensor, the at least one computing device configured to at least:

generate an outcome of a wagering game comprising a plurality of indicia;

determine that the outcome comprises an award of a bonus feature corresponding to a wheel-based gaming feature;

receive, via the at least one sensor, a skill-based input;

determine a physical property associated with the skill-based input received via the at least one sensor;

determine a location on a wheel of the wheel-based gaming feature based at least in part on the determined physical property associated with the skill-based input received via the at least one sensor;

modify at least one aspect of at least one indicia in the wheel-based gaming feature based at least in part on the location;

generate a spin of the wheel based at least in part on the determined physical property associated with the skill-based input received via the at least one sensor; and move at least one digital token associated with a current gaming session from the location to a different location based at least in part on the determined physical property associated with the skill-based input received via the at least one sensor.

2. The system of claim 1, wherein the at least one digital token associated with the current gaming session is moved in response to determining the outcome comprises the award, wherein the at least one aspect of the at least one indicia in the wheel-based gaming feature is modified based further in part on the at least one digital token.

3. The system of claim 1, wherein the at least one computing device is further configured to at least:

generate a first outcome of the wagering game; and determine the first outcome comprises an award of a first digital token, wherein the skill-based input comprises a launching of the first digital token toward the wheel and the location comprises a first landing location of the first digital token.

4. The system of claim 3, wherein the at least one computing device is further configured to at least:

generate a second outcome of the wagering game;

determine the second outcome comprises an award of a second digital token; receive a second skill-based input to launch the second digital token toward the wheel; and determine a second location on the wheel of the wheel-based gaming feature corresponding to a second landing of the second digital token based at least in part on the second skill-based input.

5. The system of claim 1, wherein the at least one aspect is modified by at least one of: altering a size of the at least one indicia, changing a position of the at least one indicia, changing a spin rate of the wheel, altering a stopping force of the wheel, altering a probability of the wheel stopping at the at least one indicia, slowing down the wheel while over the at least one indicia, speeding up the wheel while over the at least one indicia, selecting a different indicia when the wheel lands on the at least one indicia, and altering an award of winning the at least one indicia.

6. The system of claim 1, wherein the at least one computing device is further configured to randomly select the at least one aspect from a plurality of aspects.

7. The system of claim 1, wherein the sensor comprises a pressure sensor and wherein the determined physical property associated with the skill-based input received via the at least one sensor comprises a force.

8. A system comprising:

at least one display;

a sensor; and at least one computing device communicably coupled to the at least one display and the sensor, the at least one computing device configured to at least:

generate a user interface comprising a plurality of indicia corresponding to a wagering game;

generate a first outcome of the wagering game comprising an award of a digital token;

generate a second outcome of the wagering game comprising an award of a bonus feature corresponding to a wheel-based gaming feature;

receive, via the sensor, a skill-based input to launch the digital token;

determine, based on the skill-based input received via the sensor, a physical property associated with the skill-based input;

determine a landing location of the digital token on a wheel of the wheel-based gaming feature based at least in part on the physical property associated with the skill-based input;

modify at least one aspect within the user interface of at least one indicia in the wheel-based gaming feature based at least in part on the landing location;

generate a spin of the wheel; and move the digital token from the landing location based at least in part on a calculated outward force from the spin of the wheel.

9. The system of claim 8, wherein the sensor comprises a pressure sensor, wherein the physical property associated with the skill-based input comprises a force measured with the pressure sensor, and wherein the calculated outward force is determined based on the force measured with the pressure sensor.

10. The system of claim 8, wherein the at least one computing device is further configured to at least:

determine the digital token moved off of the wheel; and reverse modifying the at least one aspect of the at least one indicia in the wheel-based gaming feature in response to the digital token moving off the wheel.

11. The system of claim 8, wherein the at least one computing device is further configured to at least:

generate a third outcome of the wagering game comprising an award of a second digital token;

generate a fourth outcome of the wagering game comprising a second award of the bonus feature corresponding to the wheel-based gaming feature;

receive a second skill-based input to launch the second digital token; determine a second landing location of the second digital token on the wheel of the wheel-based gaming feature based at least in part on the second skill-based input; and modify an aspect of an indicia in the wheel-based gaming feature based at least in part on the second landing location.

12. The system of claim 8, wherein the at least one computing device is further configured to at least:

generate a third outcome of the wagering game comprising an award of a second digital token prior to generating the second outcome;

receiving a second skill-based input to launch the second digital token; determine a second landing location of the second digital token on the wheel of the wheel-based gaming feature based at least in part on the second skill-based input; and modify at least one second aspect of at least one second indicia in the wheel-based gaming feature based at least in part on the second landing location.

13. The system of claim 8, wherein the landing location on the wheel corresponds to where a trajectory of the digital token intersects the wheel.

14. The system of claim 8, wherein the at least one computing device is further configured to calculate a trajectory of the digital token based on a direction and speed of the skill-based input.

15. A method, comprising:

generating, via at least one computing device, at least one outcome of a wagering game comprising at least one award of at least one digital token;

initiating, via the at least one computing device, a bonus feature corresponding to a wheel-based gaming feature;

receiving, via a sensor, at least one skill-based input to launch the at least one digital token;

determining, via at least one computing device, at least one landing location of the at least one digital token on a wheel of the wheel-based gaming feature based at least in part on the skill-based input received via the sensor;

modifying, via at least one computing device, at least one aspect of the wheel-based gaming feature based at least in part on the at least one landing location, generating, via the at least one computing device, a plurality of spins of the wheel; and moving the at least one digital token during each of the plurality of spins based at least in part on a speed of the wheel during the plurality of spins.

16. The method of claim 15, further comprising:

receiving, via a client device, the at least one skill-based input based at least in part on at least one input of the client device; and sending, via the client device, the at least one skill-based input to the at least one computing device.

17. The method of claim 15, wherein the at least one landing location comprises an area of the wheel that spans a first indicia and a second indicia, the method further comprising selecting, via the at least one computing device, the first indicia based at least in part on a first quantity of the area that corresponds to the first indicia exceeding a second quantity of the area that corresponds to the second indicia.

18. The method of claim 17, wherein modifying the at least one aspect of the wheel comprises modifying an aspect of the first indicia in response to the first indicia being selected.

19. The method of claim 15, wherein the sensor comprises a pressure sensor, the method further comprising:

determining, via the at least one computing device, a force associated with the at least one skill-based input; and moving the at least one digital token during each of the plurality of spins based at least in part on the determined force associated with the at least one skill-based input.

20. The method of claim 15, further comprising:

determining, via the at least one computing device, a collision between a first digital token of the at least one digital token and a second digital token of the at least one digital token; and adjusting a first momentum vector corresponding to the first digital token and a second momentum vector corresponding to the second digital token based at least in part on the collision.

* * * * *